US010003122B2

(12) United States Patent
Hsiao

(10) Patent No.: US 10,003,122 B2
(45) Date of Patent: Jun. 19, 2018

(54) ANTENNA DEVICE AND COMMUNICATION DEVICE USING THE SAME

(71) Applicants: Qisda (Suzhou) Co., Ltd., Suzhou, Jiangsu (CN); Qisda Corporation, Taoyuan (TW)

(72) Inventor: Ho-Chen Hsiao, New Taipei (TW)

(73) Assignees: Qisda (Suzhou) Co., Ltd., Suzhou (CN); Qisda Corporation, Taoyuan (TW)

( * ) Notice: Subject to any disclaimer, the term of this patent is extended or adjusted under 35 U.S.C. 154(b) by 210 days.

(21) Appl. No.: 15/007,229

(22) Filed: Jan. 27, 2016

(65) Prior Publication Data

US 2016/0226147 A1 Aug. 4, 2016

(30) Foreign Application Priority Data

Feb. 2, 2015 (TW) ..... 104103397 A

(51) Int. Cl.
*H01Q 5/371* (2015.01)
*H01Q 1/24* (2006.01)
*H01Q 5/378* (2015.01)

(52) U.S. Cl.
CPC ..... *H01Q 1/243* (2013.01); *H01Q 5/371* (2015.01); *H01Q 5/378* (2015.01)

(58) Field of Classification Search
CPC ..... H01Q 1/243
See application file for complete search history.

(56) References Cited

U.S. PATENT DOCUMENTS

2014/0285384 A1* 9/2014 Hong ..... H01Q 1/243 343/702
2014/0375522 A1* 12/2014 Lin ..... H01Q 1/243 343/853
2015/0109171 A1* 4/2015 Lin ..... H01Q 9/26 343/702

FOREIGN PATENT DOCUMENTS

CN 101471491 7/2009
CN 104253309 12/2014

* cited by examiner

*Primary Examiner* — Jessica Han
*Assistant Examiner* — Amal Patel

(57) ABSTRACT

An antenna device includes a radiation part and a circuit board. The radiation part includes first to third sidewalls, an extension part and a protrusion part. The second and third sidewalls are connected to the first sidewall and opposite to each other. The extension part extends toward the third sidewall from the second sidewall. The protrusion part extends toward the first sidewall from the extension part. The circuit board includes a ground layer, a feed point, a clearance area, first metal and second metal sheets. The feed point is electrically connected to the radiation part. The clearance area is in a containing space formed by the first to third sidewalls. The first metal sheet is in the clearance area and extends from the ground layer. The second metal sheet is in the clearance area, connected to the first metal sheet and the protrusion part, and parallel to the extension part.

13 Claims, 4 Drawing Sheets

ANTENNA DEVICE AND COMMUNICATION DEVICE USING THE SAME

FIELD OF THE INVENTION

The present invention relates to an antenna device, and more particularly to an antenna device applied to a communication device.

BACKGROUND OF THE INVENTION

With the rapid development of technology, wireless mobile communication devices have been widely used in people's daily lives. A wireless mobile communication device (such as mobile phone) is usually provided with an antenna device for receiving and transmitting wireless signals. When a user is using a mobile phone for communication, the user's head is close to the antenna device of the mobile phone and may be exposed to electromagnetic radiation. In the international standard, mobile phone electromagnetic radiation is measured in units of specific absorption rate (SAR), which represents the absorbed power of body per kilogram per unit time and is in units of W/kg. In Taiwan, for example, the national communications commission (NCC) limits that the mobile phone SAR must be under 2.0 W/kg, identical to the European standard; and the US federal communications commission (FCC) limits that the mobile phone SAR must be under 1.6 W/kg. Thus, for the industry, there is a need to design an antenna device as well as a communication device complying with the SAR legal limits.

SUMMARY OF THE INVENTION

Therefore, one object of the present invention is to provide an antenna device.

Another object of the present invention is to provide a communication device equipped with the aforementioned antenna device.

The present invention provides an antenna device, which includes a radiation part and a circuit board. The radiation part includes a first sidewall, a second sidewall, a third sidewall, a first extension part and a first protrusion part. The second sidewall is connected to a first end of the first sidewall. The third sidewall is connected to a second end of the first sidewall. The third sidewall is opposite to the second sidewall. A containing space is formed by the first sidewall, the second sidewall and the third sidewall. The first extension part extends toward the third sidewall from the second sidewall. The first protrusion part extends toward the first sidewall from the first extension part. The circuit board is disposed parallel to the first sidewall. The circuit board includes a ground layer, a feed point, a clearance area, a first metal sheet and a second metal sheet. The feed point is electrically connected to the radiation part. The clearance area is disposed in the containing space. The first metal sheet is disposed in the clearance area and extends from the ground layer. The second metal sheet is disposed in the clearance area. The second metal sheet is connected to the first metal sheet, parallel to the first extension part and connected to the first protrusion part.

The present invention further provides a communication device, which includes a radiation part, a circuit board and an earpiece. The radiation part includes a first sidewall, a second sidewall, a third sidewall, a first extension part and a first protrusion part. The second sidewall is perpendicularly connected to the first sidewall. The third sidewall is perpendicularly connected the first sidewall. The third sidewall is opposite to the second sidewall. A containing space is formed by the first sidewall, the second sidewall and the third sidewall. The first extension part extends toward the third sidewall from the second sidewall. The first protrusion part extends toward the first sidewall from the first extension part. The circuit board is disposed parallel to the first sidewall. The circuit board includes a ground layer, a feed point, a clearance area, a first metal sheet and a second metal sheet. The feed point is electrically connected to the radiation part. The clearance area is disposed in the containing space. The first metal sheet is disposed in the clearance area and extends from the ground layer. The second metal sheet is disposed in the clearance area. The second metal sheet is connected to the first metal sheet, parallel to the first extension part and connected to the first protrusion part. The radiation part is disposed on a side of the communication device adjacent to the earpiece.

In summary, through forming the metal sheet by extending the ground layer of the circuit board to form a current path and consequently to modulate the current distribution, the antenna device as well as the communication device equipped with the antenna device of the present invention achieves the purpose of SAR reduction, meets the international standards and maintains qualifying efficiency while perusing the SAR reduction. Further, no modulation of the circuit manufacturing process or additional cost is required. Further, it is to be understood that the antenna device of the present invention may also be applied to a wireless mobile communication device having a metal shell.

For making the above and other purposes, features and benefits become more readily apparent to those ordinarily skilled in the art, the preferred embodiments and the detailed descriptions with accompanying drawings will be put forward in the following descriptions.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

In generally, the technology for reducing the specific absorption rate (SAR) of mobile phone antenna includes the following methods: (1) reducing conduction power of the antenna body, such as reducing electric currents to lower the electromagnetic radiation power; (2) using absorber to absorb electromagnetic waves so as to reduce SAR; (3) disposing an iron structure at the top of the antenna to block electromagnetic waves; (4) extending copper-coated area on the printed circuit board to block electromagnetic waves. However, the aforementioned methods (1) and (2) may affect the antenna characteristics, and consequently the antenna may have decreased efficiency. Further, the method (2) requires additional absorbing materials and the method (3) requires additional iron structure, which may result in increased costs. Further, the method (4) uses extended copper-coated area to block electromagnetic waves, which may not be applicable to wireless mobile communication device having a metal shell. To solve the above problems, the present invention provides an antenna device which has qualifying antenna characteristics, acceptable manufacturing cost and applicable to wireless mobile communication devices having a metal shell.

Figure 1:
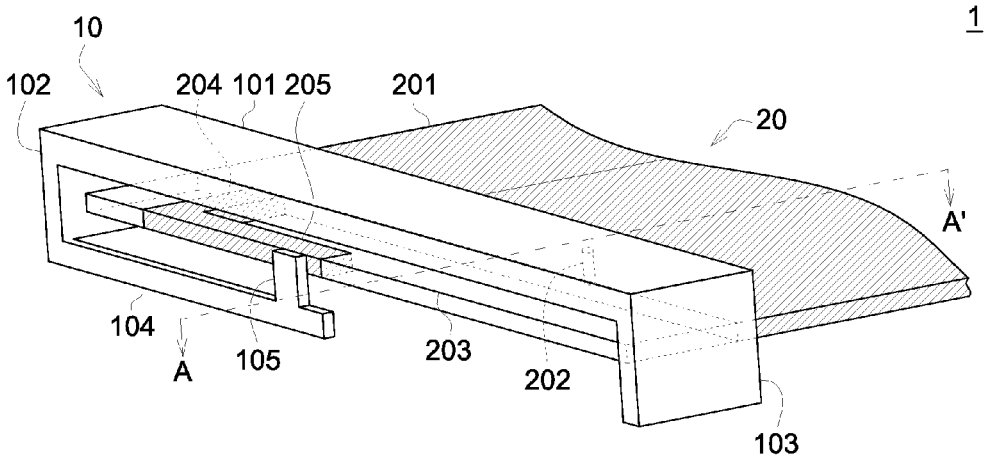
FIG. 1 is a schematic diagram of an antenna device in accordance with the first embodiment of the present invention.
Figure 2:
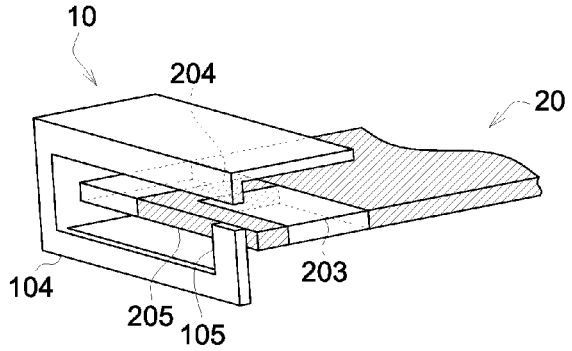
FIG. 2 is a schematic side view of the antenna device, taken along the line A-A' in FIG. 1.

Please refer to FIGS. 1 and 2. FIG. 1 is a schematic diagram of an antenna device in accordance with the first embodiment of the present invention. FIG. 2 is a schematic side view of the antenna device, taken along line A-A' in FIG. 1. As shown in FIGS. 1 and 2, the antenna device 1 of the present embodiment includes a radiation part 10 and a circuit board 20. The radiation part 10 includes a first sidewall 101, a second sidewall 102, a third sidewall 103, a first extension part 104 and a first protrusion part 105. The second sidewall 102 and the third sidewall 103 are perpendicularly connected to the first sidewall 101 and are opposite to each other. The first extension part 104 extends toward the third sidewall 103 from the second sidewall 102. The first protrusion part 105 extends toward the first sidewall 101 from the first extension part 104. The circuit board 20 is parallel to the first sidewall 101 and includes a ground layer 201, a feed point 202, a clearance area 203, a first metal sheet 204 and a second metal sheet 205. The feed point 202 is electrically connected to the radiation part 10. The clearance area 203 is disposed in a containing space formed by the first sidewall 101, the second sidewall 102 and the third sidewall 103. The first metal sheet 204 is disposed in the clearance area 203 and extends from the ground layer 201. The second metal sheet 205 is connected to the first metal sheet 204 and disposed in the clearance area 203. Further, the second metal sheet 205 is parallel to the first extension part 104 and connected to the first protrusion part 105. Each of the aforementioned devices/components will be described in detail as follows.

The antenna device 1 of the present embodiment may be applied to a communication device. Specifically, as shown in FIG. 1, the radiation part 10 may be disposed on a top side of the communication device; that is, the side of the communication device adjacent to the earpiece thereof. The radiation part 10 may constitute the metal shell on the top side of the communication device. As shown in FIG. 1, inside part of the radiation part 10 having no metal may be filled with plastic materials to constitute the shell of the communication device. The radiation part 10 is configured to generate and receive radio frequency (RF) signals of specific frequencies; wherein generation of the radio frequency signal of specific frequency may generate electromagnetic radiation.

Both of the top side and the bottom side (not shown) of the communication device may be provided with antenna devices. In one embodiment, for example, the top side of the communication device may be provided with an antenna device for a 4G LTE system, and the bottom side of the communication device may be provided with another antenna device for a 3G WCDMA system. As the earpiece is disposed relatively close to the top side of the communication device as well as the head of the user, the antenna device disposed on the top side has a greater impact on SAR; therefore, the antenna device of the present invention is exemplarily described by the antenna device disposed on the top side of a communication device. However, the present invention is not limited thereto and the antenna device of the present invention may be also disposed on the bottom side of a communication device.

As described above, the radiation part 10 of the antenna device 1 includes the first sidewall 101, the second sidewall 102 and the third sidewall 103 which are perpendicular to one another. The first sidewall 101 may constitute the back cover of the communication device; that is, the first sidewall 101 and the display device (e.g., liquid crystal display) of the communication device are disposed on different sides of the circuit board 20. In FIGS. 1 and 2, the first sidewall 101, the second sidewall 102 and the third sidewall 103 are perpendicularly connected to one another; however, it is to be understood that the illustrations are for exemplary purpose only. Namely, in an actual implementation, the connecting parts where the first sidewall 101, the second sidewall 102 and the third sidewall 103 are connected to one another may have an arc-shaped, so that exterior of the communication device can be designed accordingly.

The circuit board 20 may be disposed in the communication device. In one embodiment, the circuit board 20 is a printed circuit board, on which microprocessor, signal processing chip, display driver and RF circuit of the communication device are disposed. As described above, the circuit board 20 includes the ground layer 201, which may be made of copper and can be used as a ground voltage connection for the circuits on the circuit board 20. In FIG. 1, only the ground layer 201 is shown; however, for those ordinarily skilled in the art, it is to be understood that the circuit board 20 may further include a circuit layer on which various circuits required for the communication device are disposed.

As described above, the circuit board 20 includes the feed point 202 electrically connected to the radiation part 10, through which the signals generated by the circuits (e.g. RF circuit) on the circuit board 20 can be fed to the radiation part 10, and consequently generating the electromagnetic radiation. In addition, through the feed point 202, the RF signal received by the radiation unit 10 may also be transmitted to the circuits on the circuit board 20 for signal processing.

As described above, the circuit board 20 includes the clearance area 203 which is disposed in the containing space formed by the first sidewall 101, the second sidewall 102 and the third sidewall 103. The disposition of the clearance area 203 is for preventing the interference between the radiation part 10 and the circuits and components on the circuit board 20 from affecting the antenna characteristics. In one embodiment, the clearance area 203 is defined as an area on the circuit board 20 without copper coating.

As described above, the radiation part 10 includes the first extension part 104 which extends toward the third sidewall 103 from the second sidewall 102. Specifically, the first extension part 104 may be perpendicular to the second sidewall 102. A current path is formed by the feed point 202, the first sidewall 101, the second sidewall 102 and the first extension part 104 in sequence; and an antenna is formed by the current path together with the clearance area 203. Through proper adjustment of the length of the first extension part 104, the current path is adjusted to have a radiation frequency ranging from 1710 MHz to 2170 MHz. However, although the radiation signals of desired frequencies are generated, SAR of the antenna may exceed the legal limit. Therefore, as described above, the antenna device 1 of the present embodiment further includes the first protrusion part 105 and the metal sheets properly disposed in the clearance area 203.

As described above, the radiation part 10 of the antenna device 1 further includes the first protrusion part 105 which extends toward the first sidewall 101 from the first extension part 104. Specifically, the first protrusion part 105 may be perpendicular to the first extension part 104. As described above, the first metal sheet 204 and the second metal sheet 205 are disposed in the clearance area 203 of the circuit board 20. The first metal sheet 204 extends from the ground layer 201 and the second metal sheet 205 is connected to the first metal sheet 204. In the present embodiment, the first metal sheet 204 and the second metal sheet 205 are the area on the printed circuit board coated with copper. As described above, the second metal sheet 205 is parallel to the first extension part 104 and connected to the first protrusion part 105.

The first protrusion part 105 may be connected to the second metal sheet 205 via a metal connector (not shown). The metal connector may be metal shrapnel, through which the first protrusion part 105 is fixed to the second metal sheet 205.

In the present embodiment, the second metal sheet 205 extends toward the third sidewall 103 from the first metal sheet 204 and is connected to the first protrusion part 105 at an end thereof.

Therefore, a first current path is formed by the feed point 202, the first sidewall 101, the second sidewall 102, the first extension part 104, the first protrusion part 105, the second metal sheet 205 and the first metal sheet 204 in sequence; wherein the current distribution along the first current path is different with that along the above-described current path without the second metal sheet 205. Through proper adjustments of the length ratio of the first current path to the second metal sheet 205, desired radiation frequency and complying SAR are obtained. In one embodiment, the length ratio of the first current path to the second metal sheet 205 is ranged from 4.5 to 5.

Table 1 shows a SAR comparison between the antenna device 1 provided with the second metal sheet 205 and an antenna device provided without the second metal sheet 205; wherein the conductive power of both of the two antenna devices is set to 22 dBm. The adopted testing frequency band is frequency band B2 (with a radiation frequency of about 1900 MHz) of the universal mobile telecommunications system (UMTS). In addition, as shown in Table 1, the frequency band B2 is further divided into three channels, which are low frequency channel (L), medium frequency channel (M) and high frequency channel (H). Further, the length ratio of the first current path to the second metal sheet 205 of the adopted antenna device 1 for testing is 4.7. As shown in Table 1, the SAR of the antenna device 1 provided with the second metal sheet 205 is lower than the SAR of the antenna device provided without the second metal sheet 205 at all channels.

TABLE 1

| | Channel | | |
|---|---|---|---|
| SAR (W/kg) | L | M | H |
| antenna device provided without second metal sheet | 4.04 | 3.83 | 3.52 |
| antenna device provided with second metal sheet | 1.49 | 1.47 | 1.44 |

Table 2 shows an antenna efficiency comparison between the antenna device 1 provided with the second metal sheet 205 and an antenna device provided without the second metal sheet 205; wherein the adopted testing frequency band is frequency band B2 (with a radiation frequency of about 1900 MHz) of UMTS.

TABLE 2

| | Channel | | |
|---|---|---|---|
| Antenna Efficiency (dB) | L | M | H |
| antenna device provided without second metal sheet | −5.0 | −4.9 | −4.8 |
| antenna device provided with second metal sheet | −4.1 | −3.7 | −3.7 |

Through the above Tables 1 and 2, it is observed that by using specific antenna structure to change the current distribution, the antenna device 1 of the present embodiment can have lowered SAR (as shown in Table 1) without sacrificing the efficiency (as shown in Table 2). Thus, the antenna device 1 of the present embodiment meets not only the SAR 1.6 W/kg requirement of the American FCC but also the stricter SAR 2.0 W/kg requirement in Taiwan and Europe.

In summary, through forming the first metal sheet 204 and the second metal sheet 205 by extending the ground layer 201 of the circuit board 20, disposing the second metal sheet 205 parallel to the first extension part 104 and connecting the second metal sheet 205 to the first protrusion part 105, a current path is formed and consequently the current distribution is modulated. As a result, the antenna device of the present invention achieves the purpose of SAR reduction, meets the international standards and maintains qualifying efficiency while perusing the SAR reduction. Further, as the first metal sheet 204 and the second metal sheet 205 are formed by properly extending the metal in the ground layer 201 and coating with copper, no modulation of the circuit manufacturing process or additional cost is required. Further, it is to be understood that the antenna device of the present invention may also be applied to a wireless mobile communication device having a metal shell.

Figure 3:
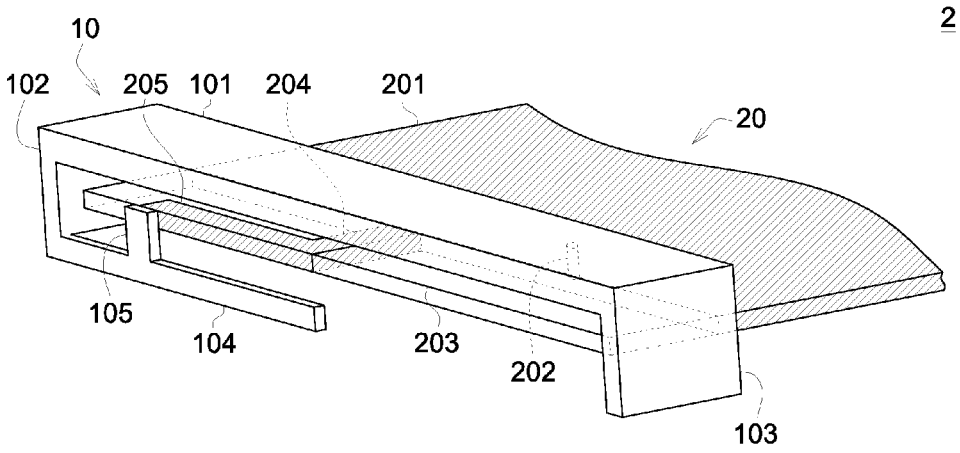
FIG. 3 is a schematic diagram of an antenna device in accordance with the second embodiment of the present invention.

FIG. 3 is a schematic diagram of an antenna device in accordance with the second embodiment of the present invention. The antenna device 2 of the second embodiment of FIG. 3 is similar to the antenna device 1 of the first embodiment of FIG. 1. The difference lies in that the metal sheet in the clearance area 203 of the antenna device 2 of the present embodiment has a different arrangement. In the antenna device 2, the second metal sheet 205 extends toward the second sidewall 102 from the first metal sheet 204 and is connected to the first protrusion part 105 at an end thereof. Therefore, in the second embodiment, the first protrusion part 105 is closer to the second sidewall 102 relative to the first metal sheet 204; that is, the relative position between the first protrusion part 105 and the first metal sheet 204 in the second embodiment is different from that of the first embodiment.

In the structure of the second embodiment, a second current path is formed by the feed point 202, the first sidewall 101, the second sidewall 102, the first extension part 104, the first protrusion part 105, the second metal sheet 205 and the first metal sheet 204 in sequence. Similarly, through proper adjustments of the length ratio of the second current path to the second metal sheet 205, desired radiation frequency and complying SAR are obtained. In one embodiment, the length ratio of the second current path to the second metal sheet 205 is ranged from 4.5 to 5. Therefore, although the metal sheet in the clearance area 203 of the antenna device 2 of the second embodiment is different from that of the antenna device 1 of the first embodiment, the antenna device 2 of the second embodiment still has the second metal sheet 205 parallel to the first extension part 104. As a result, the current distribution along the second current path is modulated and consequently the purpose of reducing the SAR is also achieved in the second embodiment.

Figure 4:
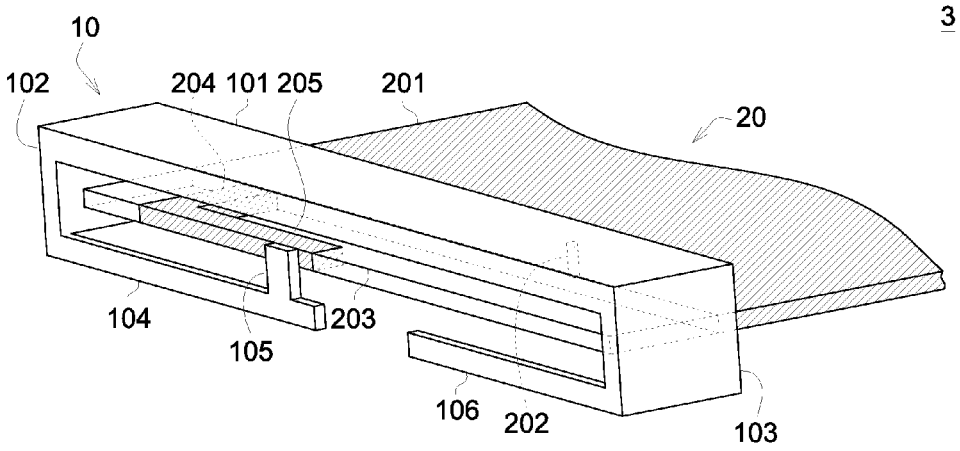
FIG. 4 is a schematic diagram of an antenna device in accordance with the third embodiment of the present invention.

FIG. 4 is a schematic diagram of an antenna device in accordance with the third embodiment of the present invention. The antenna device 3 of the third embodiment of FIG. 4 is similar to the antenna device 1 of the first embodiment in FIG. 1. The difference lies in that the radiation part 10 of the antenna device 3 of the third embodiment further includes a second extension part 106. The second extension part 106 extends toward the second sidewall 102 from the third sidewall 103 and may be perpendicular to the third sidewall 103.

In the structure of the present embodiment, a high-frequency current path is formed by the feed point 202, the first sidewall 101, the third sidewall 103 and the second extension part 106 in sequence; and an antenna is formed by the high-frequency current path together with the clearance area 203. Through proper adjustments of the length of the second extension part 106, the high-frequency current path is adjusted to have a radiation frequency ranged from 2500 MHz to 2690 MHz. It is to be noted that the antenna device 3 of the present embodiment includes at least two different radiation frequency ranges, so that the antenna device 3 of the present embodiment is capable of processing RF signals of different frequency bands.

Figure 5:
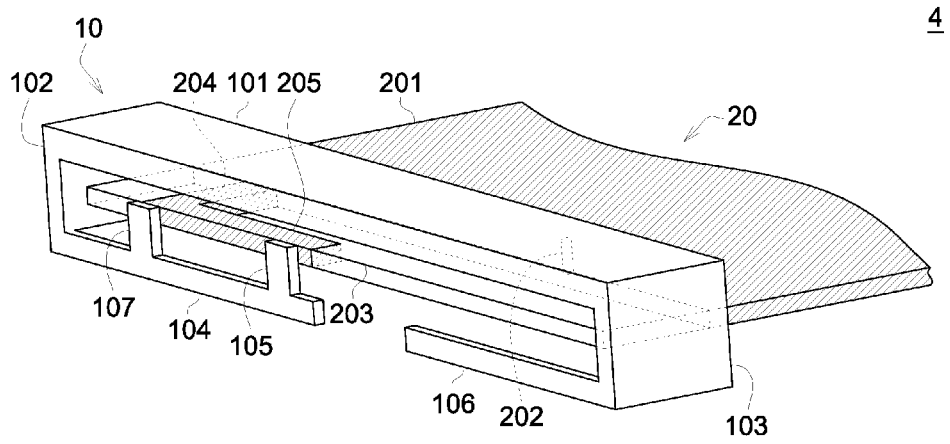
FIG. 5 is a schematic diagram of an antenna device in accordance with the fourth embodiment of the present invention.

FIG. 5 is a schematic diagram of an antenna device in accordance with the fourth embodiment of the present invention. The antenna device 4 of the fourth embodiment of FIG. 5 is similar to the antenna device 3 of the third embodiment of FIG. 4. The difference lies in that the radiation part 10 of the antenna device 4 of the fourth embodiment of FIG. 5 further includes a second protrusion part 107. The second protrusion part 107 extends toward the first sidewall 101 from the first extension part 104 and may be perpendicular to the first extension part 104. Further, the second protrusion part 107 is connected to the first metal sheet 204. Specifically, the second protrusion part 107 may be connected to the first metal sheet 204 via a metal connector (e.g., a metal shrapnel).

In the structure of the present embodiment, through connecting the second protrusion part 107 to the first metal sheet 204, the antenna device 4 of the present embodiment has a total of three current paths, which are the first current path (a loop formed by the first extension part 104, the first protrusion part 105 and the second metal sheet 205 in sequence; with a radiation frequency ranging from 1710 MHz to 2170 MHz), the high-frequency current path (via the second extension part 106; with a radiation frequency ranging from 2500 MHz to 2690 MHz), and a third current path (a loop partially formed by the second protrusion part 107 and the first metal sheet 204). Having at least three different radiation frequency ranges, the antenna device 4 of the present embodiment thus has broad applications to various areas.

Figure 6:
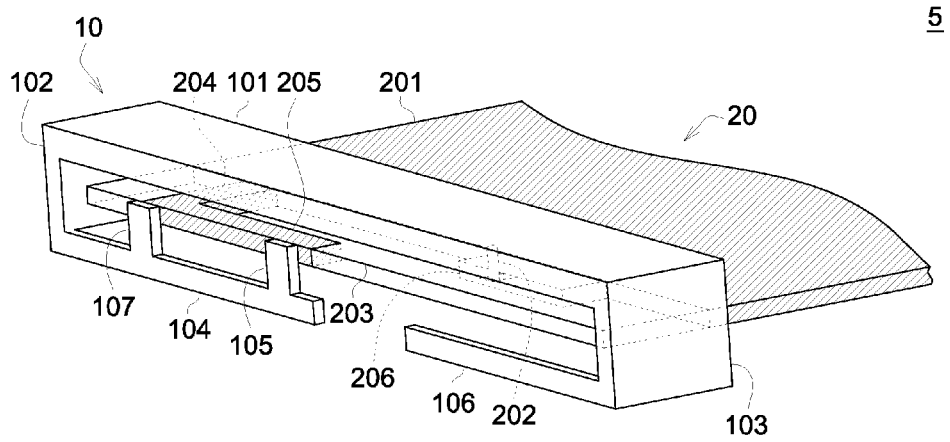
FIG. 6 is a schematic diagram of an antenna device in accordance with the fifth embodiment of the present invention.

FIG. 6 is a schematic diagram of an antenna device in accordance with the fifth embodiment of the present invention. The antenna device 5 of the fifth embodiment of FIG. 6 is similar to the antenna device 4 of the fourth embodiment of FIG. 5. The difference lies in that the circuit board 20 of the antenna device 5 of the fifth embodiment further includes a tunable matching circuit 206, which is electrically connected to the radiation part 10 via the feed point 202. The tunable matching circuit 206 provides tunable impedance that allows better impedance matching effect between the circuit board 20 and the radiation part 10; and consequently, efficiency of the antenna device 5 of the present embodiment is improved.

The antenna device of the present invention has various implementations as described above in the first to fifth embodiments and is capable of achieving the purpose of SAR reduction and complying with the international standards. It is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

Figure 7:
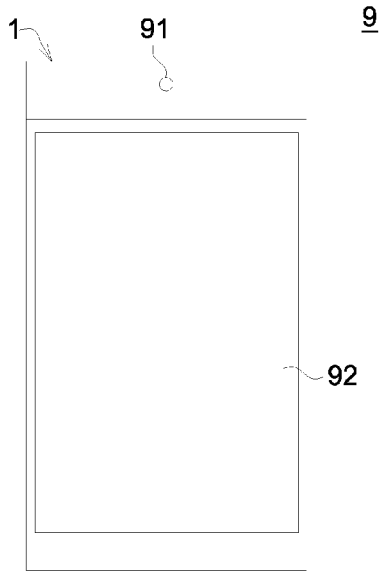
FIG. 7 is a schematic diagram of a front view of a communication device with an antenna device in accordance with an embodiment of the present invention.

The present invention further provides a communication device (e.g., mobile phone) equipped with the aforementioned antenna devices. FIG. 7 is a schematic front view of a communication device with an antenna device in accordance with an embodiment of the present invention. The communication device 9 of the present embodiment is equipped with the aforementioned antenna device 1; however, it is to be understood that the communication device 9 may be equipped with any of the aforementioned antenna devices of the present invention. The communication device 9 of the present embodiment includes an earpiece 91. The radiation part 10 is disposed on a side of the communication device 9 adjacent to the earpiece 91; that is, the radiation part 10 is disposed on the top side of the communication device 9 and adjacent to the head of the user while the user is using the communication device 9 for communication. As the structure of the antenna device 1 has been described above, no redundant detail is to be given herein.

The communication device 9 further includes a display device 92, such as a liquid crystal display (LCD) or an organic liquid crystal display (OLED) panel. The display device 92 is provided on the front side of the communication device 9, through which an operation interface and display data are provided to the user.

Figure 8:
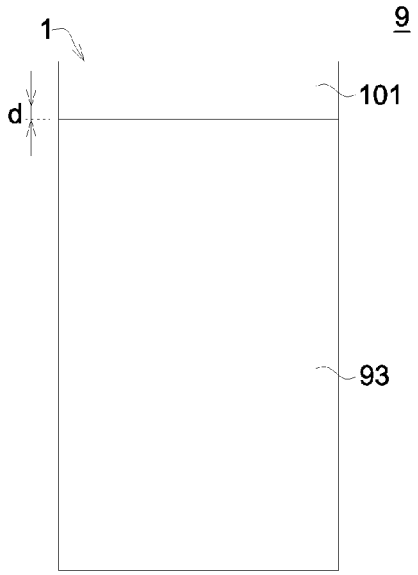
FIG. 8 is a schematic diagram of a back view of a communication device with an antenna device in accordance with an embodiment of the present invention.

FIG. 8 is a schematic back view of a communication device with an antenna device in accordance with an embodiment of the present invention. As shown, the first sidewall 101 of the antenna device 1 constitutes a part of the back cover of the communication device 9; that is, the first sidewall 101 and the display device 92 are provided on two opposite sides of the communication device 9. The communication device 9 further includes a metal back cover 93, which can be used as a back cover for battery of the communication device 9 and provide the communication device 9 a textured metal body. The metal back cover 93 and the first sidewall 101 are not connected to each other by metal; that is, plastics or other insulating materials may be filled between the metal back cover 93 and the first sidewall 101. The metal back cover 93 and the first sidewall 101 may be spaced apart for a distance d of about 1.5 mm-2 mm. Thus, through spacing the metal back cover 93 and the first sidewall 101 apart for a proper distance, antenna characteristics of the radiation part 10 would not be affected by the metal back cover 93.

Figure 9:
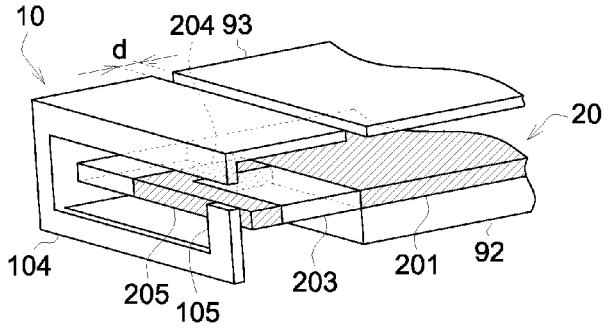
FIG. 9 is a schematic diagram of an internal structure of a communication device with an antenna device in accordance with an embodiment of the present invention, taken along the line A-A' in FIG. 1.

FIG. 9 is a schematic internal view of a communication device with an antenna device in accordance with an embodiment of the present invention, taken along the line A-A' in FIG. 1. In addition, to facilitate the comparison between FIG. 2 and FIG. 9, FIG. 9 is presented from a viewing angle identical to FIG. 2. The communication device 9 includes the radiation part 10, the circuit board 20, the display device 92 and the metal back cover 93. The display device 92 and the first sidewall 101 of the radiation part 10 are disposed on two opposite sides of the circuit board 20. The projection of the first sidewall 101 on the circuit board 20 and the projection of the display device 92 on the circuit board 20 do not overlap. In one embodiment, the projection of the first sidewall 101 on the circuit board 20 falls within the clearance area 203 of the circuit board 20. The metal back cover 93 and the first sidewall 101 of the radiation part 10 are disposed on the same side of the circuit board 20. The distance d between the metal back cover 93 and the first sidewall 101 is about 1.5 mm-2 mm. The space corresponding to the distance d between the metal back cover 93 and the first sidewall 101 may be filled with non-metallic materials, such as rubber, so that the antenna can function properly.

The metal back cover 93 may be also provided with one or more ground points (not shown), through which the metal back cover 93 is electrically connected to the ground layer 201 of the circuit board 20. In one embodiment, the metal back cover 93 is provided with six ground points which are evenly disposed around the edge of the metal back cover 93, so that the antenna characteristics of the antenna device 1 would not be affected by the metal back cover 93.

In summary, through forming the metal sheet by extending the ground layer of the circuit board to form a current path and consequently to modulate the current distribution, the antenna device as well as the communication device equipped with the antenna device of the present invention achieves the purpose of SAR reduction, meets the international standards and maintains qualifying efficiency while perusing the SAR reduction. Further, no modulation of the circuit manufacturing process or additional cost is required. Further, it is to be understood that the antenna device of the present invention may also be applied to a wireless mobile communication device having a metal shell.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An antenna device, comprising:

a radiation part, comprising:

a first sidewall;

a second sidewall, connected to a first end of the first sidewall;

a third sidewall, connected to a second end of the first sidewall, wherein the third sidewall is opposite to the second sidewall, and a containing space is formed by the first sidewall, the second sidewall and the third sidewall;

a first extension part, extending toward the third sidewall from the second sidewall; and a first protrusion part, extending toward the first sidewall from the first extension part; and a circuit board, disposed parallel to the first sidewall, the circuit board comprising:

a ground layer;

a feed point, electrically connected to the radiation part;

a clearance area, disposed in the containing space;

a first metal sheet, disposed in the clearance area and extending from the ground layer; and a second metal sheet, disposed in the clearance area, wherein the second metal sheet is connected to the first metal sheet, parallel to the first extension part and connected to the first protrusion part, wherein the second metal sheet extends toward the third sidewall from the first metal sheet and is connected to the first protrusion part at an end thereof, wherein a first current path is formed by the feed point, the first sidewall, the second sidewall, the first extension part, the first protrusion part, the second metal sheet and the first metal sheet in sequence, and a length ratio of the first current path to the second metal sheet is ranged from 4.5 to 5.

2. The antenna device according to claim 1, further comprising a metal connector, wherein the first protrusion part is connected to the second metal sheet through the metal connector.

3. The antenna device according to claim 1, wherein the radiation part further comprises a second extension part extending toward the second sidewall from the third sidewall.

4. The antenna device according to claim 1, wherein the radiation part further comprises a second protrusion part extending toward the first sidewall from the first extension part and is connected to the first metal sheet.

5. The antenna device according to claim 1, wherein the circuit board further comprises a tunable matching circuit electrically connected to the radiation part via the feed point.

6. A communication device, comprising:

a radiation part, comprising:

a first sidewall;

a second sidewall, perpendicularly connected to the first sidewall;

a third sidewall, perpendicularly connected the first sidewall, wherein the third sidewall is opposite to the second sidewall, and a containing space is formed by the first sidewall, the second sidewall and the third sidewall;

a first extension part, extending toward the third sidewall from the second sidewall; and a first protrusion part, extending toward the first sidewall from the first extension part;

a circuit board, disposed parallel to the first sidewall, the circuit board comprising:

a ground layer;

a feed point, electrically connected to the radiation part;

a clearance area, disposed in the containing space;

a first metal sheet, disposed in the clearance area and extending from the ground layer; and a second metal sheet, disposed in the clearance area, wherein the second metal sheet is connected to the first metal sheet, parallel to the first extension part and connected to the first protrusion part; and an earpiece, wherein the radiation part is disposed on a side of the communication device adjacent to the earpiece;

wherein the second metal sheet extends toward the third sidewall from the first metal sheet and is connected to the first protrusion part at an end thereof:

wherein a first current path is formed by the feed point, the first sidewall, the second sidewall, the first extension part, the first protrusion part, the second metal sheet and the first metal sheet in sequence, and a length ratio of the first current path to the second metal sheet is ranged from 4.5 to 5.

7. The communication device according to claim 6, further comprising a metal connector, wherein the first protrusion part is connected to the second metal sheet through the metal connector.

8. The communication device according to claim 6, wherein the radiation part further comprises a second extension part extending toward the second sidewall from the third sidewall.

9. The communication device according to claim 6, wherein the radiation part further comprises a second protrusion part extending toward the first sidewall from the first extension part and is connected to the first metal sheet.

10. The communication device according to claim 6, wherein the circuit board further comprises a tunable matching circuit electrically connected to the radiation part via the feed point.

11. The communication device according to claim 6, further comprising a display device, wherein the first sidewall of the radiation part and the display device are disposed on two opposite sides of the circuit board, a projection of the first sidewall on the circuit board and a projection of the display device on the circuit board do not overlap.

12. The communication device according to claim 6, further comprising a metal back cover, wherein the first sidewall of the radiation part and the metal back cover are both disposed on a side of the circuit board, the metal back cover and the first sidewall are spaced apart for a distance of about 1.5 mm-2 mm.

13. An antenna device, comprising:

a radiation part, comprising:

a first sidewall;

a second sidewall, connected to a first end of the first sidewall;

a third sidewall, connected to a second end of the first sidewall, wherein the third sidewall is opposite to the second sidewall, and a containing space is formed by the first sidewall, the second sidewall and the third sidewall;

a first extension part, extending toward the third sidewall from the second sidewall; and a first protrusion part, extending toward the first sidewall from the first extension part; and a circuit board, disposed parallel to the first sidewall, the circuit board comprising:

a ground layer;

a feed point, electrically connected to the radiation part;

a clearance area, disposed in the containing space;

a first metal sheet, disposed in the clearance area and extending from the ground layer; and a second metal sheet, disposed in the clearance area, wherein the second metal sheet is connected to the first metal sheet, parallel to the first extension part and connected to the first protrusion part, wherein the second metal sheet extends toward the second sidewall from the first metal sheet and is connected to the first protrusion part at an end thereof, wherein a first current path is formed by the feed point, the first sidewall, the second sidewall, the first extension part, the first protrusion part, the second metal sheet and the first metal sheet in sequence, and a length ratio of the first current path to the second metal sheet is ranged from 4.5 to 5.

* * * * *